US010557237B2

(12) United States Patent
Kueper

(10) Patent No.: US 10,557,237 B2
(45) Date of Patent: Feb. 11, 2020

(54) CURBSTONE DEFLECTOR FOR A SNOW-CLEARING STRIP

(71) Applicant: Kueper GmbH & Co. KG, Bochum (DE)

(72) Inventor: Roland Kueper, Bochum (DE)

(73) Assignee: Kueper GmbH & Co. KG, Bochum (DE)

( * ) Notice: Subject to any disclaimer, the term of this patent is extended or adjusted under 35 U.S.C. 154(b) by 101 days.

(21) Appl. No.: 14/702,127

(22) Filed: May 1, 2015

(65) Prior Publication Data

US 2015/0315757 A1 Nov. 5, 2015

(30) Foreign Application Priority Data

May 2, 2014 (DE) ..... 10 2014 006 274

(51) Int. Cl.
*E01H 5/06* (2006.01)

(52) U.S. Cl.
CPC ..... *E01H 5/066* (2013.01); *E01H 5/061* (2013.01)

(58) Field of Classification Search
CPC ..... E01H 5/061; E01H 5/066; E01F 3/815
See application file for complete search history.

(56) References Cited

U.S. PATENT DOCUMENTS 2,285,039 A * 6/1942 Lowe ..... E02F 3/8152 172/701.3
2,965,989 A * 12/1960 Hibbard ..... E02F 3/8152 172/701.2
3,029,534 A * 4/1962 Michael ..... E02F 3/8152 172/701.2
3,281,972 A * 11/1966 Kerestes ..... E02F 3/401 172/698
3,638,736 A * 2/1972 Hahn ..... E02F 3/8152 172/701.2
3,934,654 A * 1/1976 Stephenson ..... E01H 5/061 172/701.3
4,044,481 A * 8/1977 Eftefield ..... E02F 9/28 172/701.2
4,086,967 A * 5/1978 Eftefield ..... E02F 3/8152 172/701.2

(Continued)

FOREIGN PATENT DOCUMENTS

DE 10 2009 051 750 A1 5/2011
DE 10 2012 025 114 A1 6/2014

(Continued)

*Primary Examiner* — Jessica H Lutz
(74) *Attorney, Agent, or Firm* — Collard & Roe, P.C.

(57) ABSTRACT

A curbstone deflector for protection of the lateral end region of a snow-clearing strip attached to a snowplow clearing blade has a round or polygonally rounded-off wear edge and a recess that surrounds the end region of the snow-clearing strip, which recess has a front support surface supported on the front side of the snow-clearing strip from the front, and a lateral support surface supported on the side edge of the snow-clearing strip from the side, wherein the front support surface can be braced against the front side of the snow-clearing strip via a screw connection. The expanse of the front support surface in the longitudinal direction of the snow-clearing strip is greater by at least 1.2 times, preferably by 1.5 times than the distance between the lateral support surface and the wear edge of the curbstone deflector.

9 Claims, 8 Drawing Sheets

(56) References Cited

U.S. PATENT DOCUMENTS 4,261,115 A * 4/1981 Chittenden ..... E01H 5/061 172/701.3
4,290,214 A * 9/1981 Stepe ..... E02F 9/2808 172/701.2
4,570,366 A * 2/1986 Yost ..... E01H 5/061 172/701.1
4,833,801 A * 5/1989 Winter ..... E01H 5/066 172/701.2
4,899,472 A * 2/1990 Winter ..... E01H 5/061 37/264
5,224,555 A * 7/1993 Bain ..... E02F 3/8152 172/701.3
5,477,600 A * 12/1995 Houle ..... E01H 5/065 172/823
5,636,458 A * 6/1997 Drake ..... E01H 5/066 37/266
5,638,617 A * 6/1997 Belanger ..... E01H 5/06 37/232
D391,271 S * 2/1998 Matisz ..... D15/11
6,799,388 B2 * 10/2004 Weaver ..... E02F 3/8157 37/446
7,347,014 B1 * 3/2008 Fiandach ..... E01H 5/066 172/815
7,793,440 B1 * 9/2010 Ropog ..... E01H 5/065 37/233
8,782,930 B2 7/2014 Thomas
D766,994 S * 9/2016 Kunz ..... D15/28
2006/0123669 A1 * 6/2006 Christy ..... E01H 5/06 37/272
2007/0245600 A1 * 10/2007 Hamel ..... E01H 5/061 37/266
2009/0223090 A1 * 9/2009 Hunt ..... E01H 5/061 37/266
2009/0282706 A1 * 11/2009 Barker ..... E01H 5/061 37/196
2011/0225854 A1 * 9/2011 Winter ..... E01H 5/061 37/266
2012/0260537 A1 * 10/2012 Winter ..... E01H 5/061 37/270
2013/0025629 A1 * 1/2013 Vigneault ..... E01H 5/062 134/6
2014/0237865 A1 * 8/2014 Jones ..... E01H 5/066 37/273
2016/0069041 A1 * 3/2016 Winter ..... E02F 3/8157 37/453

FOREIGN PATENT DOCUMENTS

EP 2 496 770 B1 12/2014
KR 101252616 B1 4/2013

* cited by examiner

CURBSTONE DEFLECTOR FOR A SNOW-CLEARING STRIP

CROSS REFERENCE TO RELATED APPLICATIONS

Applicant claims priority under 35 U.S.C. § 119 of German Application No. 10 2014 006 274.0 filed May 2, 2014, the disclosure of which is incorporated by reference.

BACKGROUND OF THE INVENTION

1. Field of the Invention

The invention relates to a curbstone deflector for protection of the lateral end region of a snow-clearing strip attached to a snowplow clearing blade, which deflector has a round or polygonally rounded-off wear edge and is provided with a recess that surrounds the end region of the snow-clearing strip, which recess has a front support surface supported on the front side of the snow-clearing strip from the front, and a lateral support surface supported on the side edge of the snow-clearing strip from the side, wherein the front support surface can be braced against the front side of the snow-clearing strip by means of a screw connection.

2. Description of the Related Art

The curbstone deflectors of snow-clearing strips and their attachment to the snow-clearing strip and the snowplow clearing blade are subjected to extraordinarily great stresses during operation of the snowplow, particularly if the snowplow clearing blade has a great mass and the snowplow is driving quickly. The forces that unavoidably occur during operation, which occur when the laterally projecting curbstone deflector impacts obstacles situated at the edge of the road, sometimes overwhelm the attachment device, which can lead, in the most disadvantageous case, to the curbstone deflector coming loose from the snow-clearing strip and the snowplow clearing blade, which is extremely dangerous particularly for the road traffic that follows the plow.

A curbstone deflector of the type stated initially is known, for example, from EP 2 496 770 B1 or from U.S. Pat. No. 8,782,930 B2. In the known curbstone deflector, support of the forces that act on the wear edge essentially takes place by way of the front support surface supported on the front side of the snow-clearing strip and the lateral support surface that runs orthogonal to it, supported from the side on the side edge of the snow-clearing strip. In order for the front support surface and the lateral support surface to maintain their position relative to the lateral end region of the snow-clearing strip, a screw connection is provided, which braces the front support surface against the front side of the snow-clearing strip.

Although this curbstone deflector and its particularly configured attachment have fundamentally proven themselves, in practical use unpredictable loosening of the screw connection does occasionally occur, which can lead, in the most disadvantageous case, to loosening of the curbstone deflector during operation of the snowplow.

According to the state of the art (cf. U.S. Pat. No. 5,636,458), a curbstone deflector is furthermore known, which has a cylindrical wear body that is welded to a rectangular attachment plate along a longitudinal side, which plate in turn is screwed, by way of a screw connection, onto the end region of a snow-clearing strip attached to the snowplow clearing blade. In this connection, this attachment plate supports itself only on the front side of the snow-clearing strip, but not on its side edge, so that the screw connection is disadvantageously subjected to shear stress caused by forces acting from the side. Furthermore, the weld seam between the wear body and the attachment plate is subject to extreme bending stress, caused by forces that act on the wear body from the front, and this can lead to rupture of the weld seam.

SUMMARY OF THE INVENTION

It is the task of the invention to improve the curbstone deflector of the type stated initially, and its attachment, with regard to durability.

In a preferred embodiment of the invention, the expanse of the front support surface in the longitudinal direction of the snow-clearing strip is greater by at least 1.2 times than the distance between the lateral support surface and the wear edge of the curbstone deflector.

To accomplish this task, the invention proposes, proceeding from the curbstone deflector of the type stated initially, the front support surface has a triangular basic shape and an upper support edge that runs parallel to the longitudinal direction of the snow-clearing strip, as well as a lateral support edge that runs parallel to the side edge of the snow-clearing strip, and that the screw connection has at least two attachment screws, of which the one is disposed in the region of the upper support edge of the front support surface having the greatest possible distance from the lateral support surface, and the other in the region of the lateral support edge of the front support surface having the greatest possible distance from its upper support edge.

In view of the fact that the fixed obstacles generally make contact at the lower end of the wear edge of the curbstone deflector, great moments often occur, which act about an axis that runs along the upper edge region of the front support surface. In order to be able to absorb these moments, the described construction is well suited.

A careful analysis of the problems that occur in the state of the art, undertaken to create the invention, showed that the long-term durability of the known screw connection particularly suffers from the moments that occur during impact of the wear edge of the curbstone deflector on fixed obstacles. These moments, which are essentially caused by forces that act from the front on the wear edge of the curbstone deflector, above all act about an axis that runs along the corner region between the front support surface and the lateral support surface, and generate strong tensile forces that act on the screws of the screw connection, by means of a lever effect. As a result of these excessive tensile forces, the screws of the screw connection can be stretched in such a manner that the bias of the screw connection gives way and the screws are subsequently disadvantageously subjected to shear stress, and tear off. By means of the enlargement of the front support surface proposed according to the invention, the moments that place disadvantageous stress on the attachment apparatuses are supported with a sufficiently long lever arm. In the end result, this leads to a clear improvement in the long-term durability of the screw connection.

A practical further development of the invention provides that the expanse of the front support surface in the longitudinal direction of the snow-clearing strip is greater by more than 1.5 times than the distance between the lateral support surface and the wear edge of the curbstone deflector. By means of this extension of the lever arm, the effect discussed above is improved even further.

Furthermore, it is provided that the screw connection has at least one screw that has the greatest possible distance from the lateral support surface of the curbstone deflector, i.e. is disposed in the end region of the front support surface that faces away from the lateral support surface.

A further practical further development of the invention provides that the attachment screw disposed in the region of the upper support edge of the front support surface runs through the curbstone deflector, the snow-clearing strip, and the snowplow clearing blade, while the attachment screw disposed in the region of the lateral support edge of the front support surface runs only through the curbstone deflector and the snow-clearing strip. In this way, the particularly stable attachment of the curbstone deflector is combined with a stable attachment of the snow-clearing strip on the snowplow clearing blade. In total, a compound structure of these three parts that optimally withstands all stresses is thereby obtained.

Furthermore, it is provided that an attachment screw disposed in the region of the upper support edge of the front support surface is disposed, with reference to the lateral support edge of the front support surface, in the location where the screw holes assigned to one another are situated in the snowplow clearing blade and the snow-clearing strip. In this way, it is possible, in advantageous manner, to use the screw holes that are present in the snowplow clearing blade and the snow-clearing strip in any case to attach the curbstone deflector.

For the case that the position of the screw holes in snowplow clearing blade and snow-clearing strip do not agree with the position of the screw holes in the curbstone deflector in certain snowplow types, it is furthermore provided that the screw hold provided in the region of the upper support edge of the front support surface of the curbstone deflector is widened in the longitudinal direction of the snow-clearing strip, and can be adapted to the position of the related screw holes in the snowplow clearing blade and the snow-clearing strip by means of fitting pieces that can be inserted into this screw hole.

In order to protect the heads of the attachment screws of the screw connection from wear, it is furthermore provided that the heads of the attachment screws of the screw connection are disposed countersunk in the surface of the curbstone deflector.

Particularly long durability is obtained if the curbstone deflector is configured as a one-piece cast piece composed of a chilled casting.

BRIEF DESCRIPTION OF THE DRAWINGS

Four exemplary embodiments of the invention will be explained in greater detail below, using the drawings. These show.

DETAILED DESCRIPTION OF PREFERRED EMBODIMENTS

Figure 1:
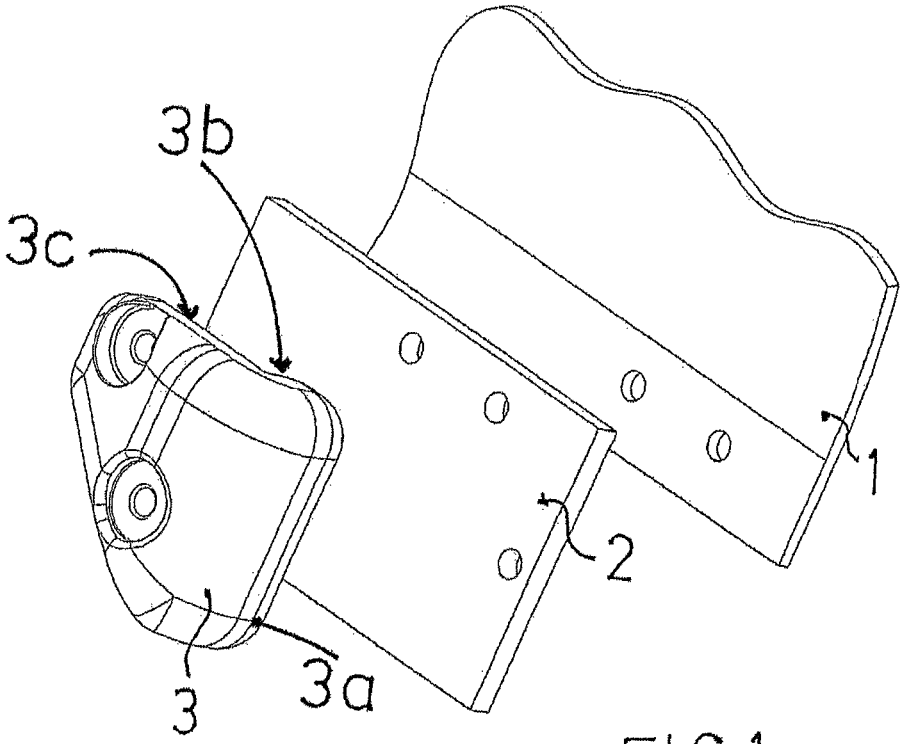
FIG. 1 shows, in an exploded representation of a first embodiment of the invention, the end section of a snowplow clearing blade, a section of the snow-clearing strip, and a curbstone deflector—without the attachment screws—.
Figure 2:
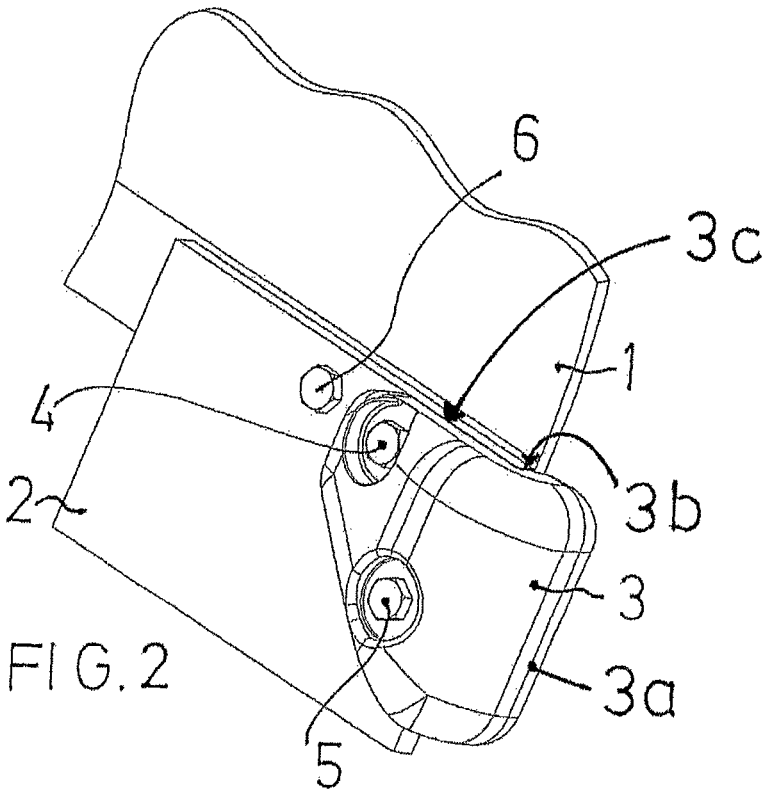
FIG. 2 shows, in perspective from the front, the parts shown in FIG. 1—including attachment screws—in finished, assembled form.
Figure 3:
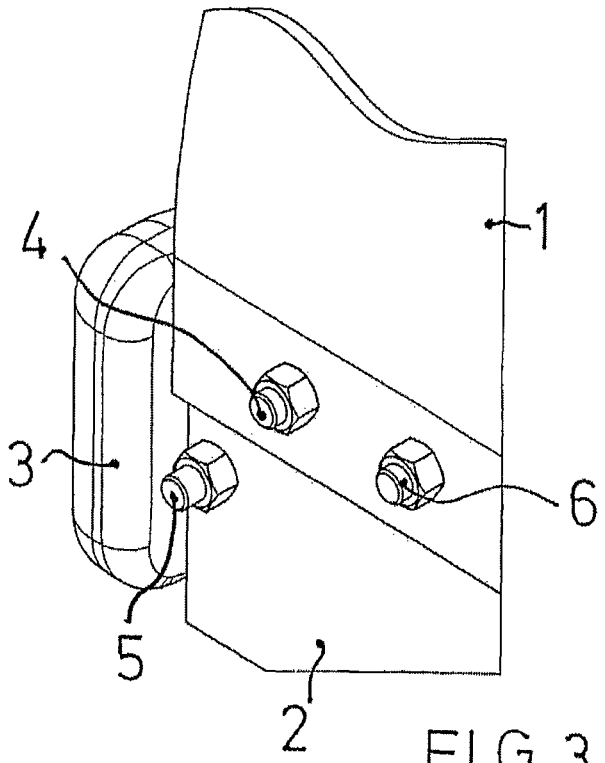
FIG. 3 shows, in perspective from the rear, the parts shown in FIG. 1—including attachment screws—in finished, assembled form.
Figure 6:
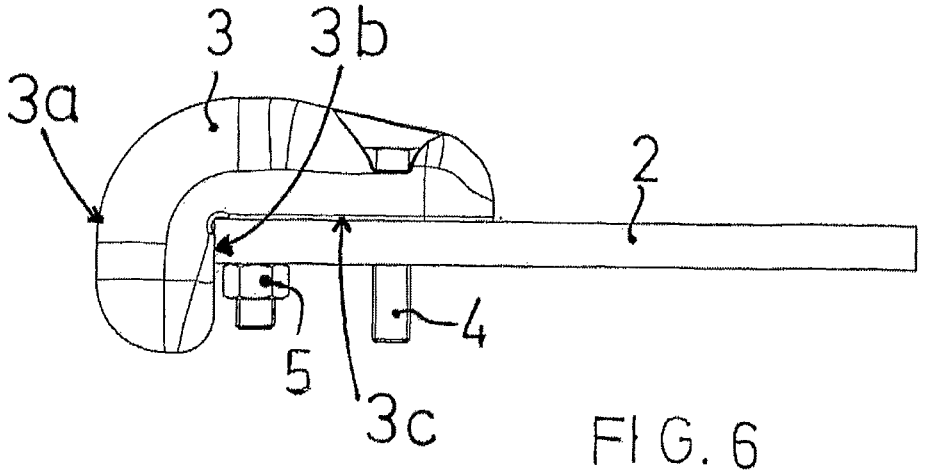
FIG. 6 is a top view of FIG. 4 from above.
Figure 5:
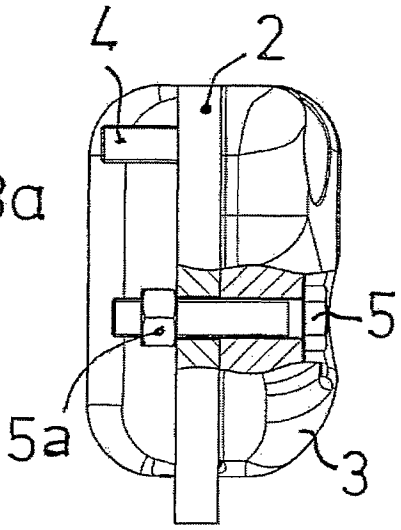
FIG. 5 is a side view—partly in section—of FIG. 4.
Figure 4:
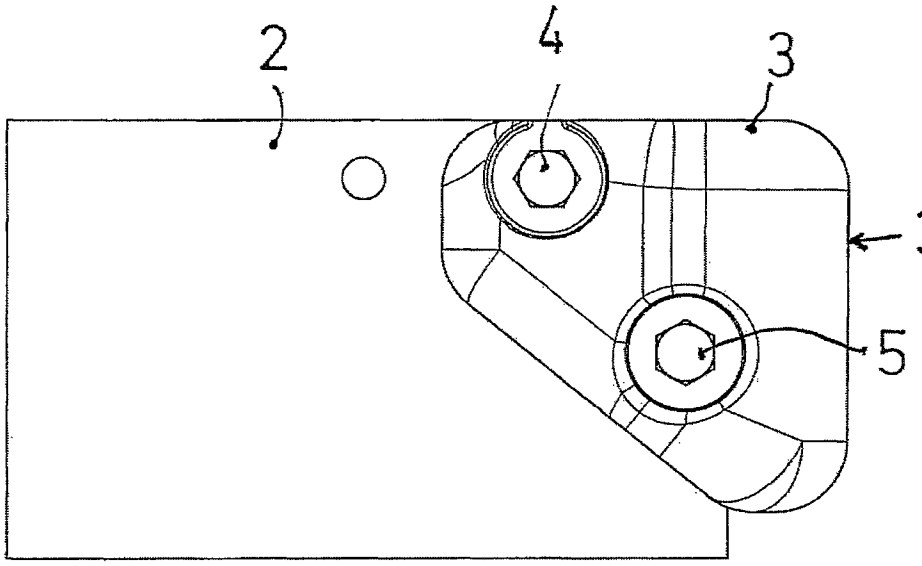
FIG. 4 is a view of the curbstone deflector evident from FIG. 1 and of the snow-clearing strip from the front—without clearing blade—but with attachment screws.
Figure 7:
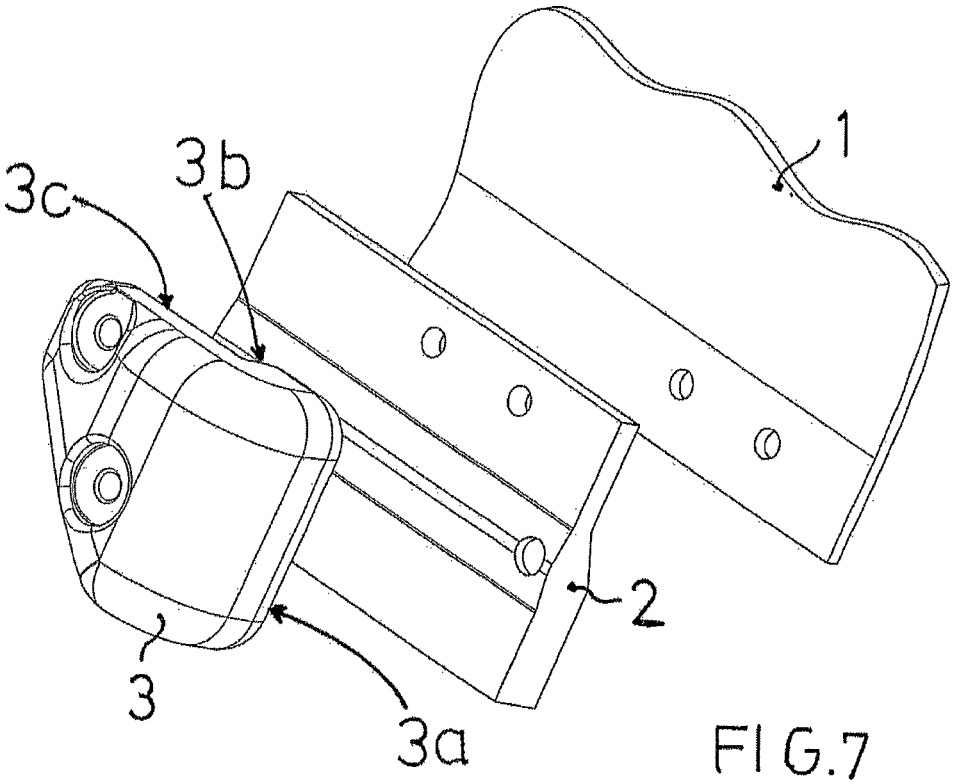
FIG. 7 shows, in an exploded representation of a second embodiment of the invention, the end section of a snowplow clearing blade, a section of the snow-clearing strip, and an edge deflector—without the attachment screws —.
Figure 8:
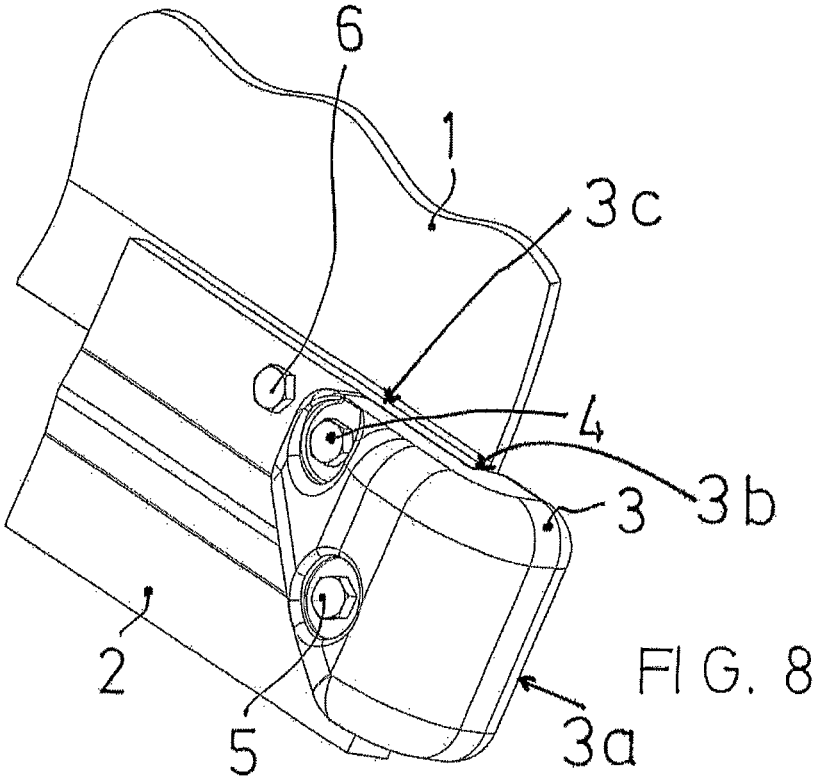
FIG. 8 shows, in perspective from the front, the parts shown in FIG. 7—including the attachment screws—in finished, assembled form.
Figure 9:
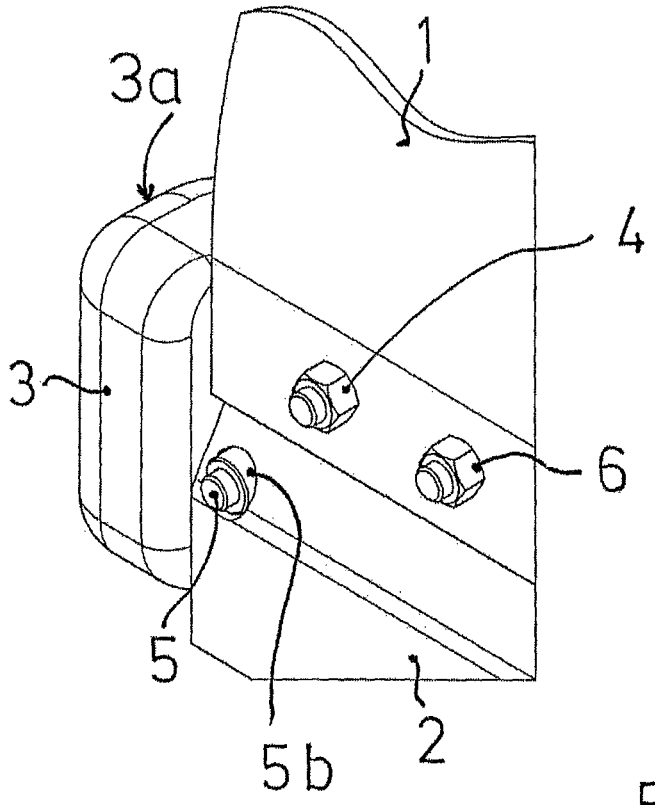
FIG. 9 shows, in perspective from the rear, the parts shown in FIG. 7—including attachment screws—in finished, assembled form.
Figure 12:
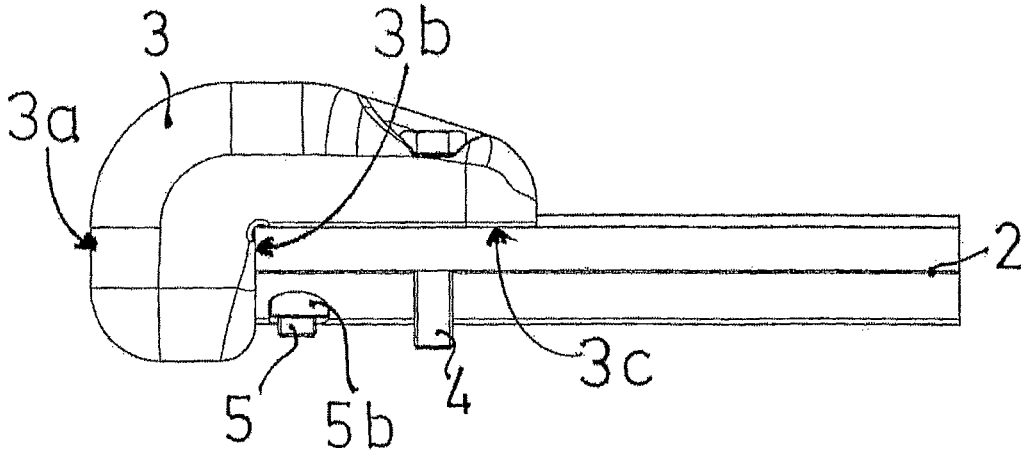
FIG. 12 is a top view of FIG. 10 from above.
Figure 11:
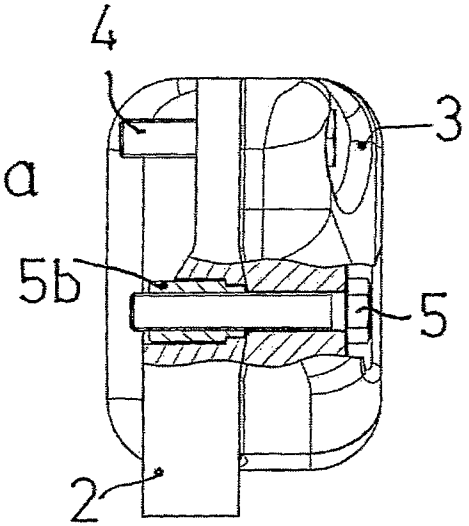
FIG. 11 is a side view—partly in section—of FIG. 10.
Figure 10:
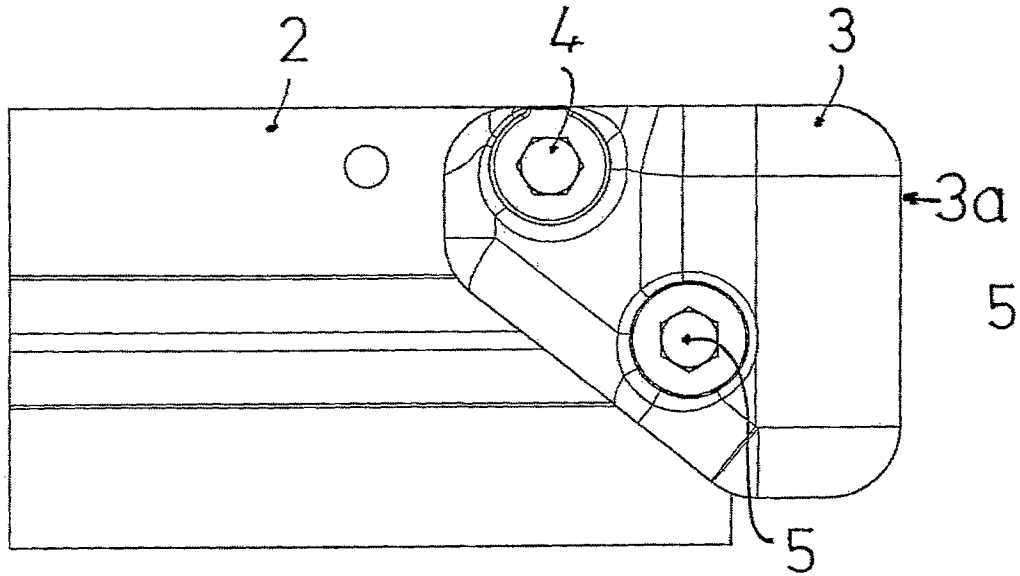
FIG. 10 is a view of the curbstone deflector evident from FIG. 7, with the snow-clearing strip, from the front—without snowplow clearing blade—but with attachment screws.

In the drawing, the main components are referred to as follows:

The snowplow clearing blade with the reference symbol 1, a snow-clearing strip that is replaceably attached to the lower edge of the blade with the reference symbol 2, a curbstone deflector that is also replaceably attached with the reference symbol 3, having a wear edge 3*a*, a lateral support surface 3*b*, and a front support surface 3*c*, and attachment screws for the curbstone deflector 3 with the reference symbols 4 and 5.

The curbstone deflectors 3 according to the invention are preferably configured in one piece and consist, for example, of a particularly wear-resistant chilled casting. They have the approximate appearance of a boxing glove, which engages around the lateral edge region of the snowplow clearing blade 1 and the snow-clearing strip 2 attached to it. On the outside, the curbstone deflectors 3 have a wear edge 3*a* having a round or polygonally rounded-off contour. On the inside, in contrast, they have a rectangular recess that has a lateral support surface 3*b*, which lies against the end of the snow-clearing strip 2 from the side, and a front support surface 3*c* that lies against the snow-clearing strip 2 from the front. In this connection, the front support surface 3*c* of the curbstone deflector 3 that lies against the snow-clearing strip 2 from the front is braced against the front of the snow-clearing strip 2 using attachment screws 4 and 5, and thereby holds the curbstone deflector 3 and its support surfaces 3*b* and 3*c* in position.

In the two embodiments according to FIGS. 1-6 and 7-12, the front support surface 3*c* of the curbstone deflector 3 has a triangular basic shape having an upper support edge that runs parallel to the longitudinal expanse of the snow-clearing strip 2, and a lateral support edge that runs parallel to the side edged of the snow-clearing strip 2. According to the invention, the expanse of the front support surface 3*c* is greater by at least 1.2 times, preferably by at least 1.5 times than the distance between the lateral support surface 3*b* and the wear edge 3*a* of the curbstone deflector 3.

According to the invention, the attachment screws 4 and 5 of the screw connection that brace the front support surface 3*c* of the curbstone deflector 3 against the snow-clearing strip 2 are furthermore disposed in a specific manner with reference to the support edges of the front support surface 3*c* of the curbstone deflector 3 explained above. Specifically, the attachment screw 4 is disposed, in the region of the upper support edge of the front support surface 3*c*, with the greatest possible distance from the lateral support surface 3*b*, while die attachment screw 5 is disposed, in the region of the lateral support edge of the front support surface 3*c*, with the greatest possible distance from its upper support edge.

This means, with reference to the attachment screw 4, that the latter is disposed in the end region of the front support surface 3*c* facing away from the lateral support surface 3*b*.

Of course, in the case of the attachment screw 5, the distance from the upper support edge of the front support surface 3*c* is only so great that the attachment screw 5 does not get into the wear region in the case of wear of snow-clearing strip 2 and curbstone deflector 3. The attachment screw 5 disposed in the region of the lateral support edge of the front support surface 3*c* therefore has the greatest possible distance from the upper support edge of the front support surface 3*c*, but is disposed above the wear region of snow-clearing strip 2 and curbstone deflector 3.

In the end result, the two attachment screws 4 and 5, in the exemplary embodiments of FIGS. 1-7 and 8-12, therefore do not lie horizontally next to one another on a line parallel to the longitudinal expanse of the snow-clearing strip 2, but rather in a line that runs at an incline to the longitudinal expanse of the snow-clearing strip 2. What is achieved in this way is that all of the moments that act on the curbstone deflector are supported by way of relatively long lever arms, in each instance, thereby causing less tensile stress on the attachment screws 4 and 5.

As can further be seen from the drawing, the attachment screw 4 disposed in the region of the upper support edge of the front support surface 3*c* runs through the curbstone deflector 3, the snow-clearing strip 2, and the snowplow clearing blade 1, in each instance, while the attachment screw 5 disposed in the region of the lateral support edge of the front support surface 3*c* runs only through the curbstone deflector 3 and the snow-clearing strip 2. The attachment screw 6 furthermore shown in the drawing merely serves to fix the snow-clearing strip 2 in place on the snowplow clearing blade 1, as is usual in the state of the art.

In the exemplary embodiment of FIGS. 1-7, the snow-clearing strip 2 is configured as a simple rectangular rail composed of wear-resistant steel. For this reason, the attachment screw 5 can be fixed in place in simple manner here, using a screw nut 5*a*, which is screwed onto the attachment screw 5 from the rear (cf. FIG. 5).

In the exemplary embodiment from FIGS. 7-12, the snow-clearing strip 2, in contrast, is configured as a commercially available steel-rubber-steel sandwich strip. Here, care must be taken to ensure that the attachment screw 5 is supported only on the steel plate of the sandwich strip that lies at the front, in order to prevent the spring effect of the rubber from impairing the strength of the screw connection. For this reason, a filler piece 5*b* is inserted into the sandwich strip, which piece supports itself on the front steel plate of the sandwich snow-clearing strip from the rear. With regard to the details of this attachment, reference is made to the older German patent application No. 10 2012 025 114.9 of the applicant, which is not, however, a prior publication.

Figure 13:
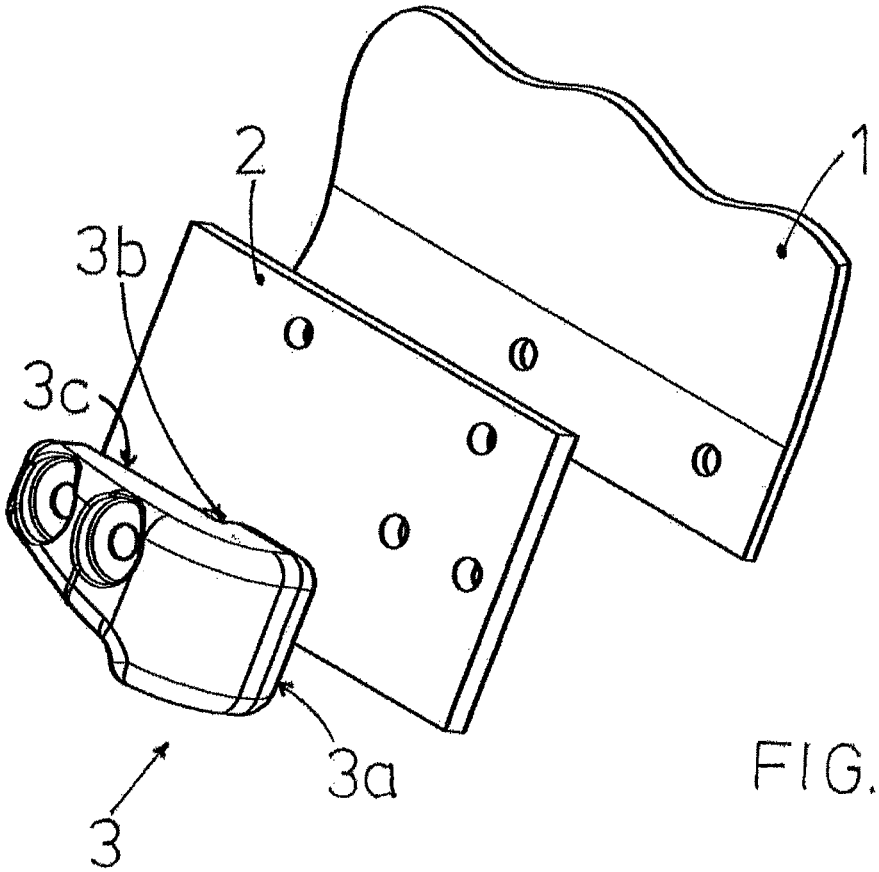
FIG. 13 shows, in an exploded representation of a third embodiment of the invention, in perspective, the snowplow clearing blade, the snow-clearing strip, and a curbstone deflector—without attachment screws —.
Figure 14:
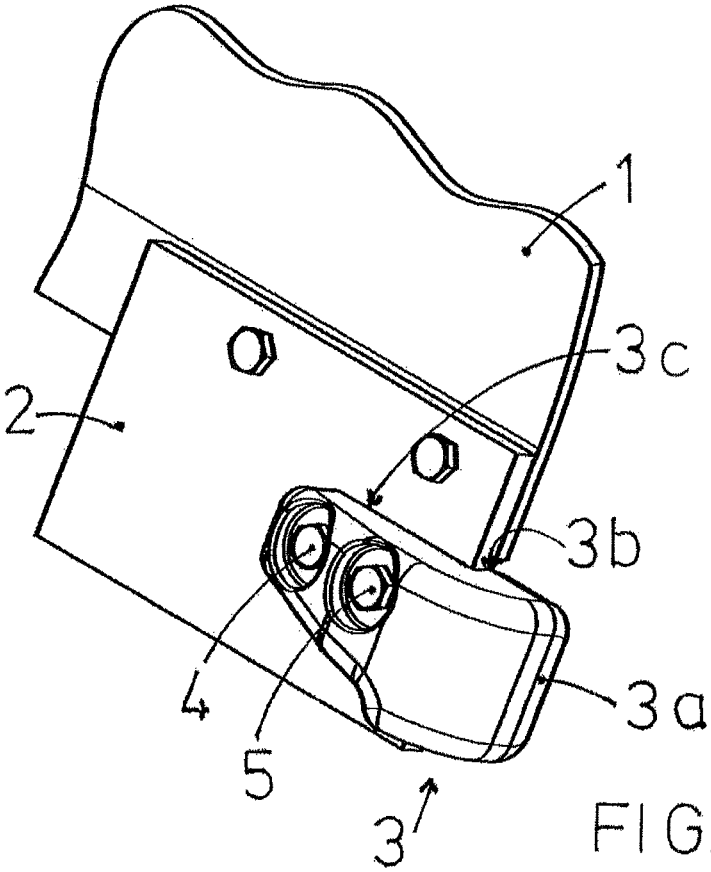
FIG. 14 shows, in perspective, the third embodiment of the invention in finished, assembled form.

In the exemplary embodiment of FIGS. 13 and 14, the front support surface 3*c* of the curbstone deflector 3 has approximately the shape of a narrow rectangle. Accordingly, here the two attachment screws 4 and 5 are disposed along a line that runs approximately parallel to the longitudinal expanse of the snow-clearing strip 2. Here, too, according to the invention, the longitudinal expanse of the front support surface 3*c* is greater, in the longitudinal direction of the snow-clearing strip 2, by at least 1.2 times, preferably by at least 1.5 times than the distance between the lateral support surface 3*b* and the wear edge 3*a* of the curbstone deflector 3. At the same time, here, too, the screw connection has a screw 4 that here, too, is disposed at the greatest possible distance from the lateral support surface 3*b* of the curbstone deflector 3. Here, too, the moments exerted when the wear edge 3*a* impacts a fixed obstacle are therefore supported with a long lever arm.

Figure 15:
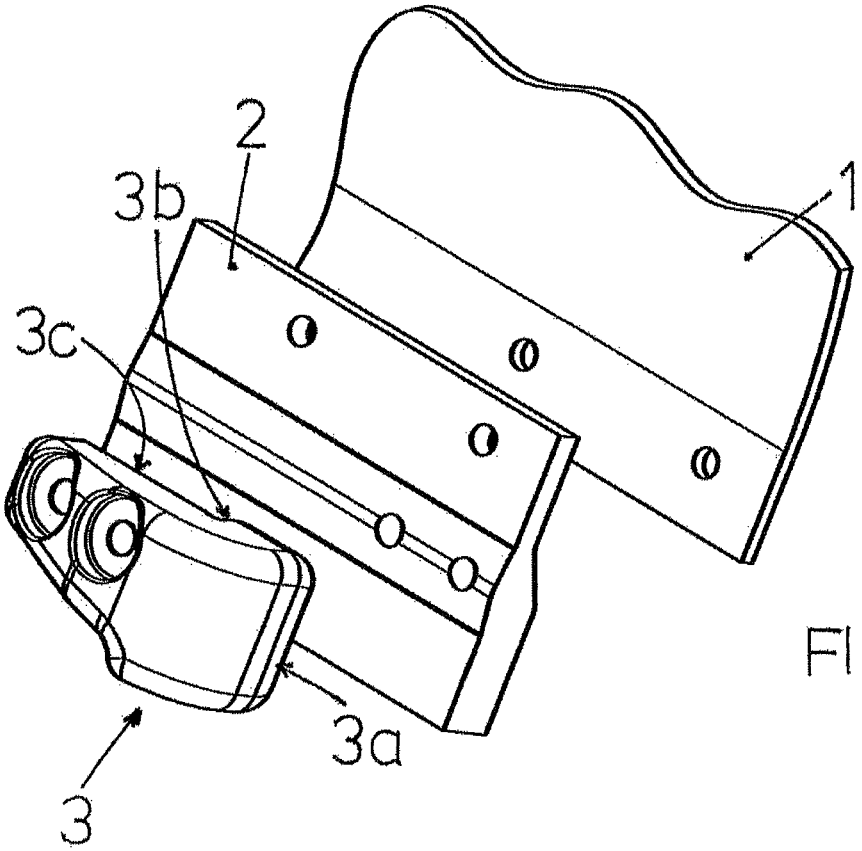
FIG. 15 shows, in an exploded representation of a fourth embodiment of the invention, in perspective, the snowplow clearing blade, the snow-clearing strip, and a curbstone deflector—without attachment screws—.
Figure 16:
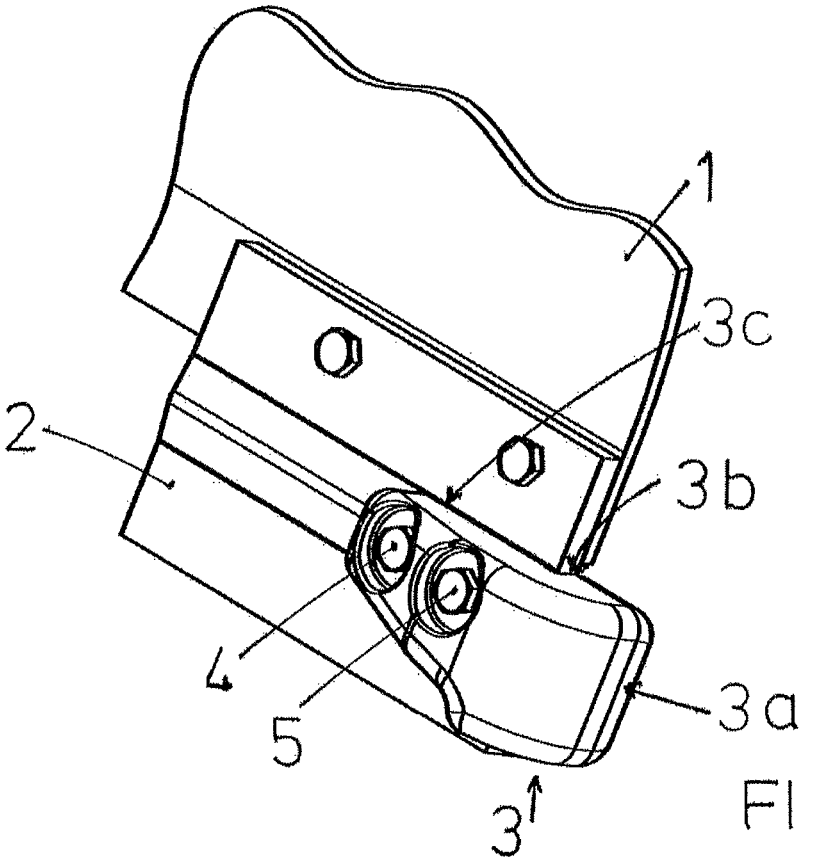
FIG. 16 shows, in perspective, the fourth embodiment of the invention in finished, assembled form.

While in the exemplary embodiment of FIGS. 13 and 14, the snow-clearing strip 2 is configured as a simple, flat rectangular rail, which—as is usual in the state of the art—is screwed onto the lower edge of the snowplow clearing blade 1 with simple attachment screws 6, in the exemplary embodiment of FIGS. 15 and 16, the snow-clearing strip 2—similar to the exemplary embodiment of FIGS. 7-12—is configured as a commercially available steel-rubber-steel sandwich strip. Accordingly, here, too, the curbstone deflector 3 is attached to the snow-clearing strip 2 in the manner explained above using FIGS. 7-12.

If the placement of the existing screw holes in the snowplow clearing blade 1 and the snow-clearing strip 2 does not agree with the placement of the screw hole for the attachment screw 4 in the curbstone deflector 3 in different snowplow types, it is furthermore provided that the screw hole for the attachment screw 4 in the curbstone deflector 3 is widened in the longitudinal direction of the snow-clearing strip 2, and can be adapted to the position of the related screw holes in the snowplow clearing blade 1 or the snow-clearing strip 2 by means of fitting pieces that can be inserted into this widened screw hole. This adaptation measure is not shown in detail in the drawing.

What is claimed is:

1. A curbstone deflector for protection of a lateral end region of a snow-clearing strip attached to a snowplow clearing blade, wherein the curbstone deflector has a round or polygonally rounded-off wear edge and is provided with a recess that surrounds the end region of the snow-clearing strip, wherein the curbstone deflector has a front support surface supported on a front side of the snow-clearing strip, and a lateral support surface supported on a side edge of the snow-clearing strip, wherein the front support surface is configured to be braceable against the front side of the snow-clearing strip via a screw connection, wherein the screw connection has at least first and second attachment screws, wherein the front support surface has a triangular basic shape and has an upper support edge that runs parallel to the longitudinal expanse of the snow-clearing strip, and has a lateral support edge that runs parallel to the side edge of the snow-clearing strip, wherein the expanse of the front support surface in a longitudinal direction of the snow-clearing strip is greater by 1.5 times than the distance between the lateral support surface and the wear edge of the curbstone deflector, and wherein the first attachment screw is disposed in the region of the upper support edge of the front support surface, and the second attachment screw is disposed in the region of the lateral support edge of the front support region and at a lowermost region of the front support surface.

2. The curbstone deflector according to claim 1, wherein the screw connection has at least one screw that is disposed in a longitudinally front region of the front support surface facing away from the lateral support surface.

3. The curbstone deflector according to claim 1, wherein the first attachment screw runs through the curbstone deflector, the snow-clearing strip, and the snowplow clearing blade, while the second attachment screw runs only through the curbstone deflector and the snow-clearing strip.

4. The curbstone deflector according to claim 3, wherein the first attachment screw is disposed, with reference to the lateral support edge of the front support surface, at the location where the screw holes assigned to one another in the snowplow clearing blade and the snow-clearing strip are situated.

5. The curbstone deflector according to claim 4, wherein the screw hole provided in the region of the upper support edge of the front support surface of the curbstone deflector is widened in the longitudinal direction of the snow-clearing strip, and can be adapted to the position of the related screw holes in the snowplow clearing blade and the snow-clearing strip via fitting pieces that can be inserted into this screw hole.

6. The curbstone deflector according to claim 1, wherein heads of attachment screws of the screw connection are disposed countersunk in the surface of the curbstone deflector.

7. The curbstone deflector according to claim 1, wherein the curbstone deflector is configured as a one-part cast or forged piece.

8. An assembly comprising a snow-clearing strip attached to a snowplow clearing blade and a curbstone deflector for protection of a lateral end region of the snow-clearing strip, wherein the curbstone deflector has a round or polygonally rounded-off wear edge and is provided with a recess that surrounds the end region of the snow-clearing strip, wherein the curbstone deflector has a front support surface supported on a front side of the snow-clearing strip, and a lateral support surface supported on a side edge of the snow-clearing strip, wherein the front support surface is braced against the front side of the snow-clearing strip via a screw connection, wherein the screw connection has at least first and second attachment screws, wherein the front support surface has a triangular basic shape and has an upper support edge that runs parallel to the longitudinal expanse of the snow-clearing strip, and has a lateral support edge that runs parallel to the side edge of the snow-clearing strip, wherein the expanse of the front support surface in a longitudinal direction of the snow-clearing strip is greater by 1.5 times than the distance between the lateral support surface and the wear edge of the curbstone deflector, and wherein the first attachment screw is disposed in the region of the upper support edge of the front support surface, and the second attachment screw is disposed in the region of the lateral support edge of the front support region and at a lowermost region of the front support surface.

9. A curbstone deflector for protection of a lateral end region of a snow-clearing strip attached to a snowplow clearing blade, wherein the curbstone deflector has a round or polygonally rounded-off wear edge and is provided with a recess that surrounds the end region of the snow-clearing strip, wherein the curbstone deflector has a front support surface supported on a front side of the snow-clearing strip, and a lateral support surface supported on a side edge of the snow-clearing strip, wherein the front support surface is configured to be braceable against the front side of the snow-clearing strip via a screw connection, wherein the screw connection has at least first and second attachment screws, wherein the front support surface has a triangular basic shape and has an upper support edge that runs parallel to the longitudinal expanse of the snow-clearing strip, and has a lateral support edge that runs parallel to the side edge of the snow-clearing strip, wherein the expanse of the front support surface in a longitudinal direction of the snow-clearing strip is greater by at least 1.2 times than the distance between the lateral support edge and the wear edge of the curbstone deflector, and wherein the first attachment screw is disposed in the region of the upper support edge of the front support surface, and the second attachment screw is disposed in the region of the lateral support edge of the front support region and at a lowermost region of the front support surface.

* * * * *